US005096183A

United States Patent [19]

Hauck et al.

[11] Patent Number: 5,096,183

[45] Date of Patent: Mar. 17, 1992

[54] SYSTEM FOR CONTROLLING SHEET FEED IN SHEET-PROCESSING MACHINES, PARTICULARLY PRINTING PRESSES

[75] Inventors: Dieter Hauck, Eberbach; Edmund Schramek, Sinsheim, both of Fed. Rep. of Germany

[73] Assignee: Heidelberger Druckmaschinen AG, Heidelberg, Fed. Rep. of Germany

[21] Appl. No.: 642,684

[22] Filed: Jan. 17, 1991

[30] Foreign Application Priority Data

Jan. 17, 1990 [DE] Fed. Rep. of Germany ..... 4001120

[51] Int. Cl.[5] ..... B65H 7/08

[52] U.S. Cl. ..... 271/227; 271/261

[58] Field of Search ..... 271/227, 261, 258, 259, 271/263

[56] References Cited

U.S. PATENT DOCUMENTS 4,892,426 1/1990 Steele ..... 271/261 X
5,021,676 6/1991 Dragon ..... 271/261 X

FOREIGN PATENT DOCUMENTS 0047413 3/1982 European Pat. Off. .
1402961 8/1975 United Kingdom .
2168687 6/1986 United Kingdom .

*Primary Examiner*—Richard A. Schacher
*Attorney, Agent, or Firm*—Herbert L. Lerner; Laurence A. Greenberg

[57] ABSTRACT

A system for controlling sheet feed in a sheet-processing machine having a feed table with front stops thereon includes a scanning device in the vicinity of the front stops for detecting an arrival of a sheet thereat. An angle sensor is attached to a shaft of the sheet-processing machine. A computing/control device has a device for assigning scanning signals from the scanning means to respective angular positions $\phi$actual with stored setpoint values $\phi$setpoint, for computing positioning data for correcting a subsequent arrival of a sheet, if there is a deviation $\Delta\phi$ between angular positions $\phi$actual and the stored setpoint values $\phi$setpoint, and for transmitting the positioning data to an actuating device.

19 Claims, 3 Drawing Sheets

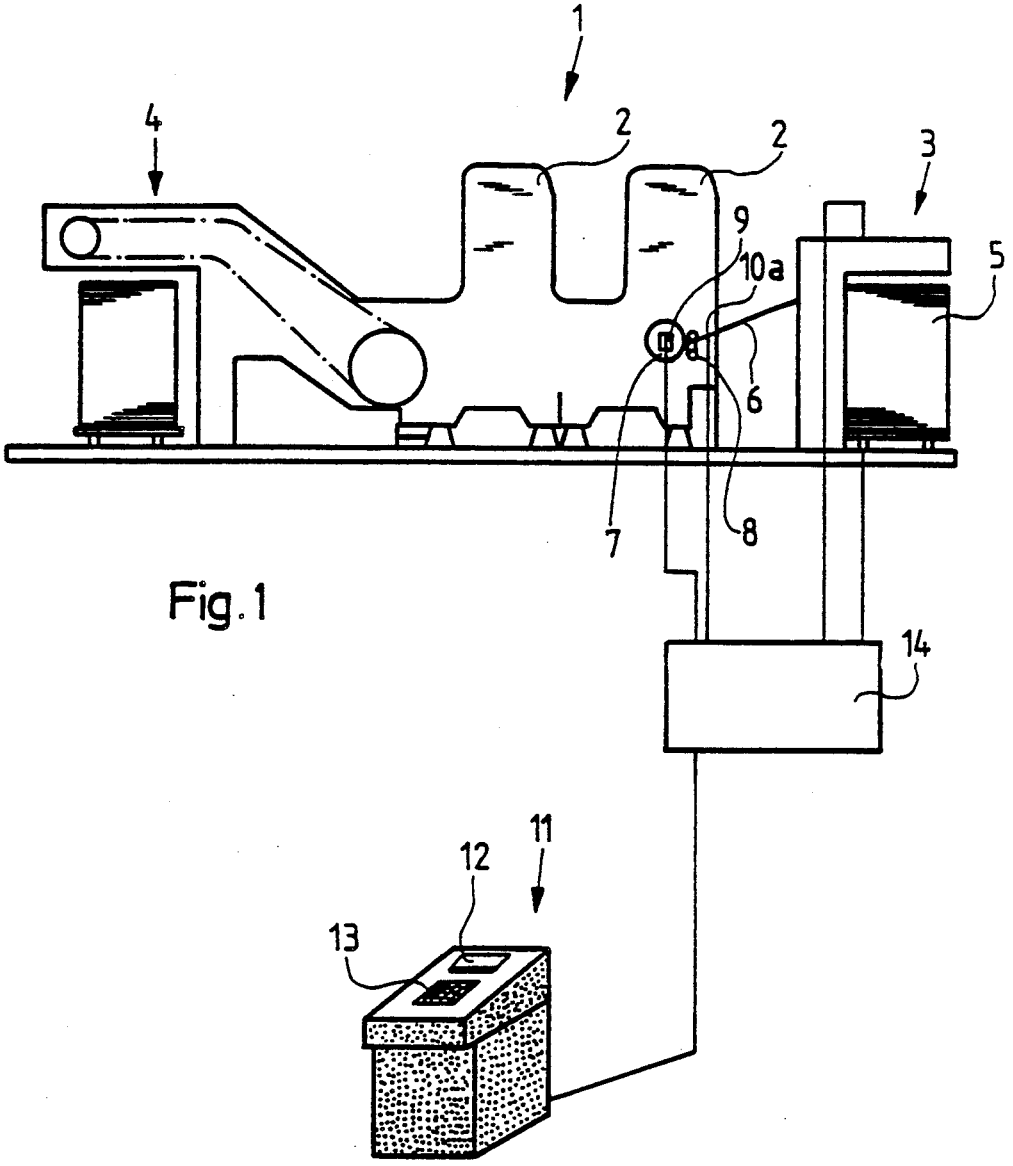
Fig. 1
Fig. 2
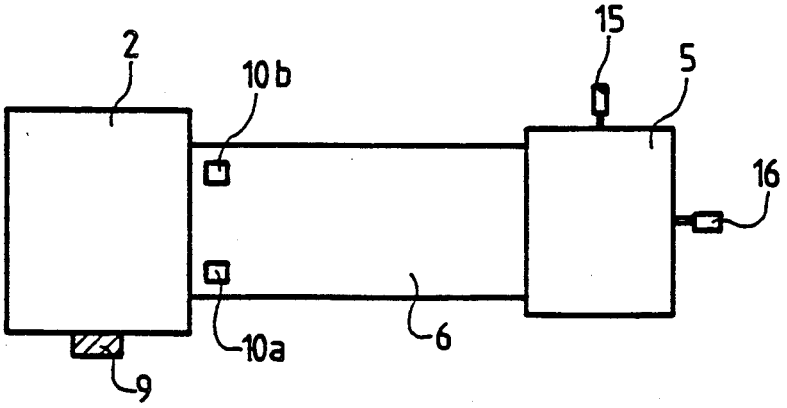

SYSTEM FOR CONTROLLING SHEET FEED IN SHEET-PROCESSING MACHINES, PARTICULARLY PRINTING PRESSES

The invention relates to a system for controlling sheet feeding in sheet-processing machines, particularly printing presses.

To print sheets in offset printing presses, the sheets are lifted in phase with the printing press individually from a pile of sheets, and are transported via conveyor belts and timing rollers in a continuous shingled or fish scale stream to front stops of a feed table. Grippers of a register feed drum accept the sheets from a rest position and accelerate them to press speed.

The in-register transfer of the sheets presupposes that the sheets arrive at the front stops at a preselected angular position of the printing press and/or that the front or leading edges of the sheets are aligned perpendicularly with respect to the conveying direction of the sheets. If both of these conditions are not satisfied, the sheets will be gripped non-uniformly, or, in extreme cases, will not be gripped at all, by the gripper support surfaces, which may result in jamming of paper in the region of the feeder and to sheet loss in the press, respectively. Either case triggers a stoppage of the feeder and the press, respectively.

Deviations from the preselected, optimum degree setting at sheet arrival are inherent to the process and unavoidable. Thus, the arrival of the sheets is delayed i.e. slows down, as the speed of the press increases. Furthermore, at constant press speed, arrival of the sheets is dependent upon the weight of the paper; assuming that the settings are identical, light paper arrives later at the front stops than cardboard. In addition, the skewed position of the sheets increases with increasing press speed, because the times for aligning the front or leading edges of the sheets along the front stops become shorter and shorter. Incorrect settings in the region of the feeder can then no longer be compensated for by the inertia of the sheets.

German Published Non-Prosecuted Application (DE-OS) 22 02 851 describes a device for automatic start-up of printing in sheet-conducting machines, particularly in printing presses with an overlapping or shingled infeed of sheets. The feed table is provided with paper-scanning light spots in the vicinity of the front lays. In addition, angle sensors are disposed on a shaft of the press, and operate switches within preselected angular ranges by means of cams. This time- or angle-related control in synchronism with the press determines three scanning intervals for the light spots per revolution of the press, the scanning intervals serving for identification of so-called early sheets, late sheets and okay sheets. A registration of an early, late or also skewed sheet triggers an immediate stoppage of the printing press.

European Patent 0 047 413 describes a process and a device for controlling the arrival of sheets of flexible material at the inlet of sheet-processing machines, particularly printing presses, the arrival of the sheet at a feed point being detected by scanning means within a preselected time interval and within a preselected angle-of-rotation range, respectively. Defined within the time range (okay range) is a second, shorter time range (optimum time range). The instant a sheet arrives at the feed point outside this optimum time range, the manual or automatic readjustment of sheet feeding is triggered.

A decisive disadvantage of both heretofore known constructions is that the current degree setting at sheet arrival, as well as the degree setting characterizing the skewed position of the sheet, is known only in the order of magnitude of the fixed scanning intervals. Trend-based and process-inherent changes in the degree setting at sheet arrival or in the skewed position of the sheets are not accessible to measurement.

Because the printer has no available information on trend-based changes in the feeding of the sheets, the entire printing process continues to be highly dependent upon the expertise of the respective printer.

A further disadvantage of the two herein aforementioned publications is that changes to the magnitude of the intervals can be effected only by means of the mechanical adjustment of two cams, it being necessary for the printing press to be stopped for performing such an adjustment. It is also not possible during the printing process to change the optimum time range once it has been preset. Consequently, it is not possible, for example, to effect a speed-dependent change of the degree setting at sheet arrival while the press is in operation.

Proceeding from this state of the prior art, it is an object of the invention to provide a device which determines the arrival of a sheet at the inlet of a printing press and/or the skewed position of a sheet in terms of degree settings and, in the event of a deviation from preselected setpoint values, computes and performs corresponding corrections.

With the foregoing and other objects in view, there is provided, in accordance with the invention, a system for controlling sheet feed in a sheet-processing machine having a feed table with front stops thereon, comprising scanning means in vicinity of the front stops for detecting an arrival of a sheet thereat, an angle sensor attached to a shaft of the sheet-processing machine, and a computing/control device having means for assigning scanning signals from the scanning means to respective angular positions $\phi$actual of the angle sensor and for comparing the angular positions $\phi$actual with stored setpoint values $\phi$setpoint, for computing positioning data for correcting a subsequent arrival of a sheet, if there is a deviation $\Delta\phi$ between angular positions $\phi$actual and the stored setpoint values $\phi$setpoint, and for transmitting the positioning data to an actuating device.

In accordance with another feature of the invention, the scanning means comprise a scanner disposed in a central region of the feed table.

It is extremely advantageous that, besides the degree setting or number-of-degrees detection of sheet arrival, it is also possible to provide precise information on the skewed position of the sheet. For this purpose, in accordance with a further feature of the invention, the scanning means comprise two scanners disposed substantially symmetrically with respect to a center line of the feed table. The scanning signals are assigned to the corresponding angular positions of the angle sensor. A particularly advantageous effect is provided by the fact that the scanners can be used simultaneously for monitoring the sheet arrival and the sheet feeding.

In accordance with an additional feature of the invention, the computing/control device has means for determining the angular positions to which the scanning signals are applied, and the means for computing positioning data is for effecting a skewed positioning of subsequently arriving sheets, and the actuating device is a servomotor.

In accordance with an added feature of the invention, the computing/control device has means for determining a mean value of the angular positions as an actual value $\phi$actual for a degree setting at sheet arrival, if there is a deviation of the angular positions.

In accordance with yet another feature of the invention, the computing/control device has means for computing, in a case wherein deviations $\phi$actual of measured and computed angular positions, respectively, from preselected angular positions $\phi$setpoint exist, corresponding positioning data for a phase adjustment, and for transmitting the data to a servomotor.

In accordance with yet a further feature of the invention, the control device includes a means for switching the scanning means selectively on and off. Thus, for example, the detection of the skewed position of the sheets can be dispensed with in the case of cardboard if the press speed is not too high.

In accordance with yet an added feature of the invention, the sensor is an absolute-value sensor, and is connected to a counter.

In accordance with an alternate feature of the invention, the angle sensor is an incremental sensor, the sensor being connected to a counter.

Due to the angle resolution which is randomly selectable within broad limits and which corresponds to the dimensioning of the individual angular increments, it is possible to determine very precisely the angular position of the printing press at sheet arrival.

If the angular position of the printing press at sheet arrival, which can be determined with great accuracy, were to be constantly regulated to the preselected setpoint value, this might have a negative effect on the printing process and thus on the quality of the printed products. The reason for this is that, viewed statistically, there occur in the "normal" printing process now and again so-called "runaway", the cause of which is not attributable to incorrect settings of the mechanical parts of the sheet feeder. In the case of such "runaways", a response of the feedback-control device must be suppressed, because, as a result of the inertia of the mechanical actuating parts, there is otherwise the risk, after the setting has been controlled or regulated to the incorrect sheet, that waste will be printed.

Thus, in accordance with still another feature of the invention, the computing/control device has means for computing a mean value from a multiplicity of measurements of the angular positions assigned to the scanning signals from the scanning means, the means value serving as the actual value $\phi$actual for control.

In accordance with an alternative feature of the invention, the computing/control device has means for initiating control to a stored setpoint value $\phi$setpoint, if the angular positions to which the scanning signals are assigned from the scanning means are beyond a tolerance range for the stored setpoint value.

In accordance with still a further feature of the invention, the computing/control device has means for determining the tolerance range by a spreading of the actual or measured values about the means value.

This statistical evaluation further has the advantage that trend-based changes with regard to the feeding of the sheets become detectable and can be distinguished from periodically occurring "runaways". Whereas it is not desired that the computing/feedback-control device should respond to "runaways", it is necessary to compensate for trend-based changes in the course of a production run, which occur with the sheet arrival having been originally optimally set and which, for example, are caused by wear to mechanical parts. Viewed as exceptionally advantageous is also that, due to the statistical evaluation of the numbers of degrees or degree setting at sheet arrival, an objective yardstick is available for the quality and uniformity of sheet transport. On the basis of experimentally determined reference values, it is also possible to attribute faults in sheet feeding, for example, to wear on the suckers or to incorrect settings of suction- or blown-air nozzles. Such fault or error messages are indicated to the printer on the display of the control desk.

In accordance with still an additional feature of the invention, means are included for manually inputting to the computing/control device at least one of the setpoint value $\phi$setpoint and the tolerance range. The printer is thus able to allow his or her experience to be incorporated into the printing process.

In accordance with still an added feature of the invention, the sheet-feed control system includes, a control desk connected to the computer/control device, and having means for acoustically signalling deviations $\Delta\phi$ from a respective setpoint value $\phi$setpoint.

In accordance with another feature of the invention, the sheet-feed control system includes a control desk having a central information display connected to the computer/control device for visually displaying deviations $\Delta\phi$ from a respective setpoint value $\phi$setpoint.

In accordance with a further feature of the invention, the sheet-feed control system includes means for also displaying corresponding positioning data for the computing/control device at the central information display, and further including means for effecting a manual control in accordance with the displayed positioning data.

Whereas the aforedescribed features seek to provide the printer with an opportunity to introduce his or her experience into the printing process, a further embodiment of the invention pursues the objective of automating the printing process in the startup phase.

In accordance with an additional feature of the invention, the sheet-feed control includes means for inputting to the computing/control device, prior to a printing start, a weight of the paper to be used in the subsequent printing, and the computing/control device having means for determining an optimum degree setting at sheet arrival for the respective weight of the paper. The computing/feedback-control apparatus assigns this given weight of the paper to the appropriately stored, experimentally determined, optimum starting setting for the feeder. The paper weight-dependent, automatic setting of the phase position of the feeder ensures a trouble-free startup of sheet transport and that from the beginning of the printing process, the printing is of high quality.

In accordance with an added feature of the invention, the sheet-feed control system includes means for superimposing a speed compensation on the deviations $\Delta\phi$ from the setpoint value $\phi$setpoint.

In accordance with a concomitant feature of the invention, the computing control device includes means for performing a statistical evaluation of measured data and comparing a result of the evaluation with experimentally determined data whereby conclusions may be drawn regarding components of a sheet transporting system of the sheet-processing machine.

Other features which are considered as characteristic for the invention are set forth in the appended claims.

Although the invention is illustrated and described herein as embodied in a system for controlling sheet feed in sheet-processing machines, particularly printing presses, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 1 is a diagrammatic and schematic side elevational view of a printing press incorporating the sheet-feeding control system of the invention;

Figure 2A:
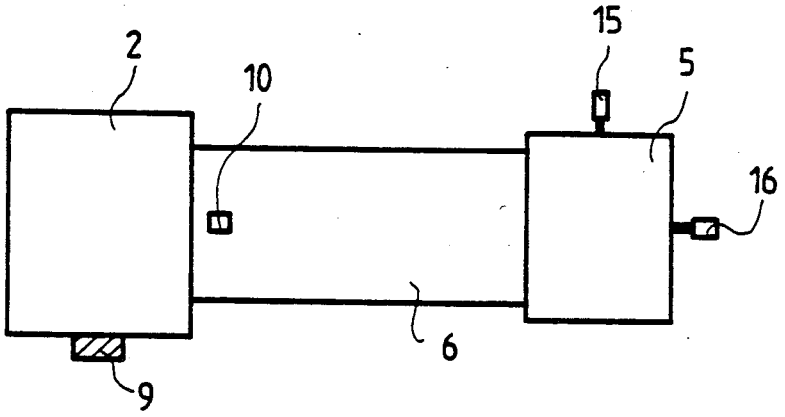
FIG. 2 is an enlarged fragmentary top plan view of FIG. 1 showing the feeder region of the printing press.
Figure 3:
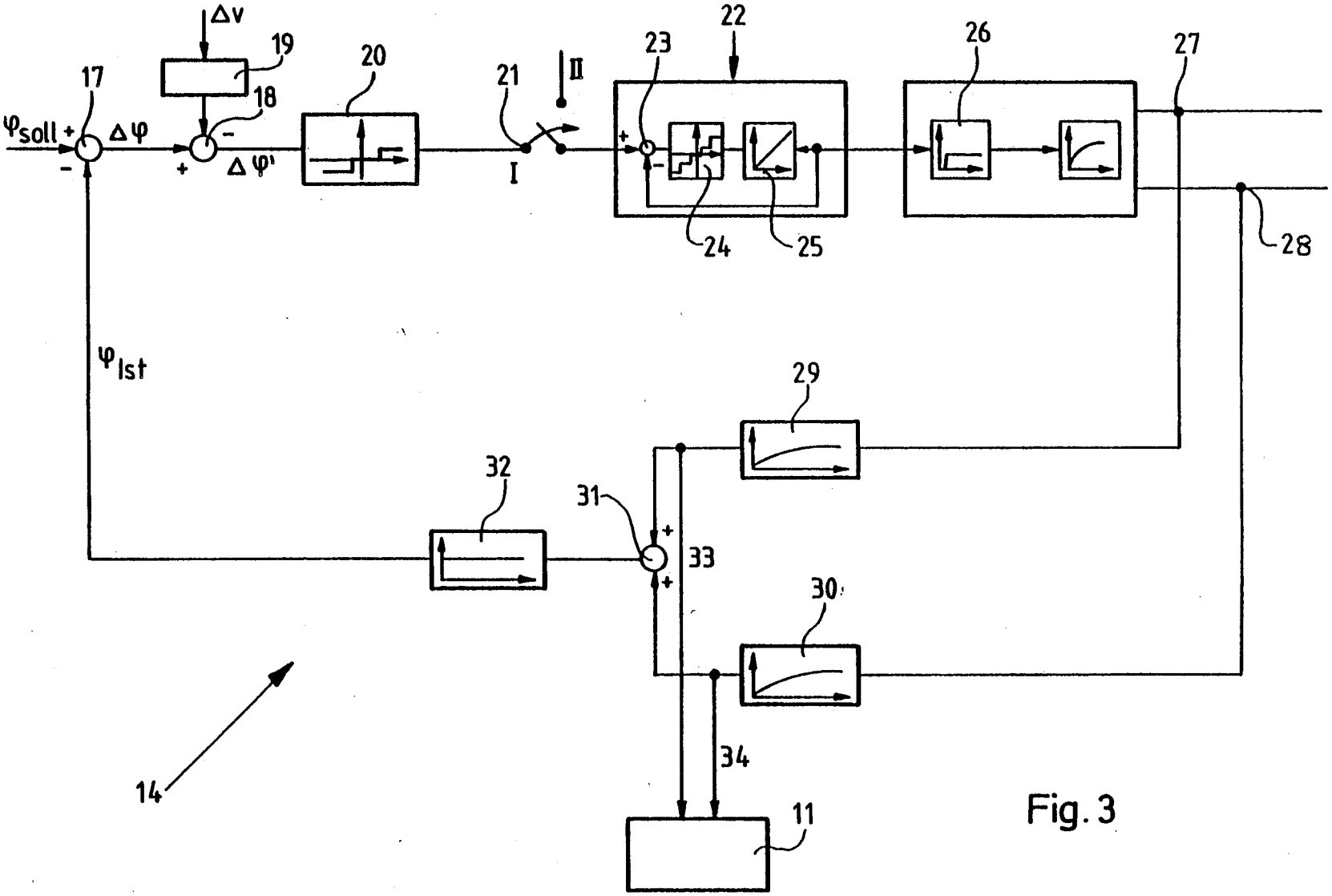

FIG. 2*a* is another view like that of FIG. 2 of another embodiment of the feeder region; and FIG. 3 is a block diagram showing schematically the structure and function of the control system for sheet arrival at the feeder of the printing press.

Referring now to the drawing and, first, particularly to FIG. 1 thereof, there is shown therein diagrammatically and schematically a printing press 1 with two printing units 2, a feeder 3 and a delivery 4. A suction head (not shown in FIG. 1) lifts the sheets individually from a pile of sheets 5 and transports them in a continuous shingled or fish-scale stream across a feed table 6 to front stops 8 of the printing press 1. A gripper system of a register feed drum 7 grips front or leading edges of the sheets and accelerates the sheets from a rest position to press speed.

An angle sensor 9 is attached to a shaft of the register feed drum 7. A computing/control device assigns scanning signals from scanners 10*a* and 10*b*, which signal the arrival of the sheet, to respective angular positions of the printing press 1, which are determined as degree settings i.e. in numbers of degrees, by the angle sensor 9. Then, from the difference of the measured and the preselected angular positions, the computing/control device 14 computes positioning data for skew and phase adjustment of the sheets in the feed region of the printing press 1.

The computing/control device 14 is connected to a control deck 11. Located on an upper side of the control deck 11 is a central information display 12, which indicates or displays the calculated positioning data to the printer. Furthermore, by means of the keyboard 13, the printer has an opportunity to intervene in the control loop and to make necessary presettings and corrections manually.

FIG. 2 is a diagrammatic top plan view of the feed area and of the first printing unit 2 of a printing press 1. An angle sensor 9 is disposed on a shaft in the first printing unit 2. Operator-side and drive-side scanners 10*a* and 10*b* are disposed symmetrically with respect to the center of the feed table 6 in the vicinity of the front stops 8. Phase adjustment is accomplished by means of a servomotor 15, which varies the feed of the sheets by deflecting a feeder drive chain. Skew positioning of the sheets is achieved by a servomotor 16, which varies relative positions of drag-type suckers of the suction head with respect to one another. FIG. 2*a* illustrates another embodiment of FIG. 2 which differs therefrom by providing only one scanner 10 which is located at the center of the feed table 6 in the vicinity of the front stops 8.

FIG. 3 is a block diagram of the computer/control device 14 and its connection to the control desk 11. Sheet arrival at the feeder 3 of the printing press 1 is controlled thereby. At 17, a difference between a preselected, optimum number of degrees at sheet arrival $\phi$setpoint and a measured number of degrees at sheet arrival $\phi$actual is obtained. At 18, a disturbance value or quantity is applied to the control deviation $\Delta\phi$. A compensation circuit 19 may entail, for example, an application of a disturbance value or quantity which takes into account a dependence of the number of degrees at sheet arrival upon the speed of the printing press. The functional relationship of both values or quantities is known. A change in speed $\Delta\phi$ is transmitted to the compensation circuit 19. The change in the number of degrees at sheet arrival, which is linked with the change in speed, is determined via a compensation characteristic and is applied to the deviation at 18. The compensation of known disturbance values or quantities upstream of the computing/control device 14 offers the advantage that such disturbances are corrected before they take effect at the feeder. A considerably more constant or steadier transport of the sheets in the feeder region is achieved thereby.

A computer 20 determines positioning the servomotors 15 and 16 according to the remaining control deviation $\Delta\phi$ after the compensation of the disturbance values or quantities. A possibility is provided at 21 to select, by means of a switch, either manual (II) or automatic control (I) of the servomotors.

Subordinate to the computing/control device 14 is a control loop 22 for positioning the servomotors. A computer board 24 thereof computes a precise positioning of the servomotor 25. At 23, a difference of the computed actual and setpoint positions of the servomotor is obtained and the control loop 22 is closed.

Block 26 represents the feeder of the printing press as a controlled system.

At 27 and 28, respective numerical angular positions determined by the angle sensor 9 are assigned to the scanning signals from the scanners 10*a* and 10*b*. At 29 and 30, a mean value is formed from the corresponding numbers of degrees at sheet arrival over a multiplicity of sheets. At 31, smoothed signals are added, and at 32, a mean value of these smoothed signals is formed. This mean value is fed to the computing/control device 14 as the angular-position actual value $\phi$actual.

After being smoothed at 29 and 30, the scanning signals are transmitted via lines 33 and 34 to the central information display 12 of the control desk 11 for output.

We claim:

1. System for controlling sheet feed in a sheet-processing machine having a feed table with front stops thereon, comprising scanning means in vicinity of the front stops for detecting an arrival of a sheet thereat, an angle sensor attached to a shaft of the sheet-processing machine, and a computing/control device having means for assigning scanning signals from said scanning means to respective angular positions $\phi$actual of said angle sensor and for comparing said angular positions $\phi$actual with stored setpoint values $\phi$setpoint, for computing positioning data for correcting a subsequent arrival of a sheet, if there is a deviation $\Delta\phi$ between angular positions $\phi$actual and said stored setpoint values $\phi$setpoint, and for transmitting said positioning data to an actuating device.

2. Sheet-feed control system according to claim 1, wherein said scanning means comprise a scanner disposed in a central region of the feed table.

3. Sheet-feed control system according to claim 1, wherein said scanning means comprise two scanners disposed substantially symmetrically with respect to a center line of the feed table.

4. Sheet-feed control system according to claim 1, wherein said computing/control device has means for determining said angular positions to which said scanning signals are applied, and said means for computing positioning data is for effecting a skewed positioning of subsequently arriving sheets, and said actuating device is a servomotor.

5. Sheet-feed control system according to claim 4, wherein said computing/control device has means for determining a mean value of said angular positions as an actual value $\phi$actual for a degree setting at sheet arrival, if there is a deviation of said angular positions.

6. Sheet-feed control system according to claim 1, wherein said computing/control device has means for computing, in a case wherein deviations $\phi$actual of measured and computed angular positions, respectively, from preselected angular positions $\phi$setpoint exist, corresponding positioning data for a phase adjustment, and for transmitting said data to a servomotor.

7. Sheet-feed control system according to claim 1, including means for switching said scanning means selectively on and off.

8. Sheet-feed control system according to claim 1, wherein said sensor is an absolute-value sensor, and is connected to a counter.

9. Sheet-feed control system according to claim 1, wherein said angle sensor is an incremental sensor, said sensor being connected to a counter.

10. Sheet-feed control system according to claim 1, wherein said computing/control device has means for computing a mean value from a multiplicity of measurements of said angular positions assigned to said scanning signals from said scanning means, said means value serving as said actual value $\phi$actual for control.

11. Sheet-feed control system according to claim 1, wherein said computing/control device has means for initiating control to a stored setpoint value $\phi$setpoint, if said angular positions to which said scanning signals are assigned from said scanning means are beyond a tolerance range for the stored setpoint value.

12. Sheet-feed control system according to claim 11, wherein said computing/control device has means for determining said tolerance range by a spreading of said actual or measured values about said means value.

13. Sheet-feed control system according to claim 11, including means for manually inputting to said computing/control device at least one of said setpoint value $\phi$setpoint and said tolerance range.

14. Sheet-feed control system according to claim 11, including a control desk connected to said computer/-control device, and having means for acoustically signalling deviations $\Delta\phi$ from a respective setpoint value $\phi$setpoint.

15. Sheet-feed control system according to claim 11, including a control desk having a central information display connected to said computer/control device for visually displaying deviations $\Delta\phi$ from a respective setpoint value $\phi$setpoint.

16. Sheet-feed control system according to claim 15, including means for also displaying corresponding positioning data for said computing/control device at said central information display, and further including means for effecting a manual control in accordance with the displayed positioning data.

17. Sheet-feed control system according to claim 1, including means for inputting to said computing/control device, prior to a printing start, a weight of the paper to be used in the subsequent printing, and said computing/control device having means for determining an optimum degree setting at sheet arrival for the respective weight of the paper.

18. Sheet-feed control system according to claim 1, including means for superimposing a speed compensation on said deviations $\Delta\phi$ from said setpoint value $\phi$setpoint.

19. Sheet-feed control system according to claim 1, wherein said computing/control device comprises means for performing a statistical evaluation of measured data and comparing a result of said evaluation with experimentally determined data whereby conclusions may be drawn regarding components of a sheet transporting system of the sheet-processing machine.

* * * * *